US011385003B1

(12) United States Patent
Tasyagan

(10) Patent No.: US 11,385,003 B1
(45) Date of Patent: Jul. 12, 2022

(54) PLASTIC RECEIVER WITH METAL MAGAZINE SLOT WITH CARTRIDGE RAMP

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 17/225,076

(22) Filed: Apr. 7, 2021

(51) Int. Cl.
*F41A 3/66* (2006.01)
*F41A 17/38* (2006.01)

(52) U.S. Cl.
CPC ..... *F41A 3/66* (2013.01); *F41A 17/38* (2013.01)

(58) Field of Classification Search
USPC ..... 42/75.01
See application file for complete search history.

(56) References Cited

U.S. PATENT DOCUMENTS 6,070,354 A * 6/2000 Burigana ..... F41C 23/18 42/71.01
9,297,599 B2 * 3/2016 Underwood ..... F41A 3/66
9,631,885 B2 * 4/2017 Jones ..... F41A 9/24
10,731,934 B2 * 8/2020 Song ..... F41A 3/66
2016/0258697 A1 9/2016 Hoon
2016/0273857 A1 9/2016 Pettit et al.
2017/0356706 A1 12/2017 Beaty

FOREIGN PATENT DOCUMENTS

TR 201900095 A2 7/2020

OTHER PUBLICATIONS

Search report provided by Turk Patent for Applicant's foreign filed patent application (TR201900095), Report was completed on Oct. 30, 2020 and letter sent to Applicant's representative dated Nov. 4, 2020.

* cited by examiner

*Primary Examiner* — Reginald S Tillman, Jr.
(74) *Attorney, Agent, or Firm* — Narek Zohrabyan; Phil IP Law Inc.

(57) ABSTRACT

The subject of the invention is for a plastic receiver and a combination of a magazine holder and cartridge ramp made of a metal material formed as a whole. Thereafter, the whole is placed in the mold for injection molding, casting or for plastic printing. The formation of receiver integrates a metal structure of the magazine holder with the cartridge ramp such that the plastic case (receiver) is highly resistant to abrasion, breaking, as well as to weather conditions.

3 Claims, 3 Drawing Sheets

PLASTIC RECEIVER WITH METAL MAGAZINE SLOT WITH CARTRIDGE RAMP

TECHNICAL FIELD

The subject matter of the disclosure relates to a magazine slot and a cartridge ramp made of metal, integrated into a plastic receiver with injection molding and/or casting method by using the plastic and the metal structure of the magazine slot with a cartridge ramp that results in a plastic receiver that is highly resistant to abrasion, breakage and environmental conditions.

BACKGROUND

In the relevant field of the art, some firearms contain plastic receivers that are wholly made of plastic. In those instances, the plastic receiver is worn out or even broken over time due to the friction created from operating the firearm.

As a result, the magazine slot—made of plastic—is worn out and deformed over time due to the use of metal magazines when loading or unloading the firearm.

Another disadvantage of some of these firearm configurations is that they are adversely affected by hot and cold weather conditions because they are wholly made of plastic. This is because the plastic magazine slot expands or contracts due to the effects of heat and cold. As a result, the magazine slot is deformed, causing insertion and removal of a magazine difficult as the tolerance ranges change due to the environmental impact.

In the relevant field of the art, as ammunition is fed from the magazine to the barrel, the friction generated causes the cartridge ramp to be worn out and/or deformed. Moreover, during firing or cycling of the rifle, the cartridges being fed from the magazine hit the cartridge ramp and are guided into the barrel. As a result, the cartridge ramp also wears out over time and loses functionality. Thus, the affected cartridge ramp makes it difficult to safely feed the ammunition from the magazine and into to the barrel after some time.

The subject matter of the current disclosure is a plastic receiver with a magazine slot and cartridge ramp made of metal designed as an efficient and highly reliable structure in a way to eliminate the problems illustrated above.

SUMMARY

In accordance with an aspect of the disclosure, there is provided a system, including:

A receiver with a receiver body made from injection molding, casting of a plastic or plastic type material and a metal magazine e slot integrated into the receiver body. The receiver incorporating a metallic cartridge ramp at an inclined on the upper side of the metal magazine slot that provides a guide as ammunition feeds into the barrel from the metal magazine slot. The receiver incorporates a preventive barrier at the bottom of the metal magazine slot allowing a magazine to be attached to the receiver body. The receiver further uses an auricle shape defining the bottom base of the preventive barrier located on the metal magazine slot.

DESCRIPTION OF THE DRAWINGS

Embodiments in accordance with the present disclosure are shown in the drawings and will be described below with reference to the figures, whereby elements having the same effect have been provided with the same reference numerals. The following is shown.

LIST OF NUMERALS

Numbers are placed on the figures in order to better illustrate the plastic receiver with the metal magazine slot with the cartridge ramp which is the subject matter of the current disclosure. The numerals are as follows:

1. Receiver body,
2. Metal magazine slot,
2A. Magazine positioning opening,
2B. Magazine locking groove,
2C. Magazine support protrusion,
2D. Cartridge ramp, and
2E. Preventive barrier.

DETAILED DESCRIPTION

The disclosure herein involves first forming a metal magazine slot with a cartridge ramp. This can be achieved by way of molding or some other manufacturing technique. Then, a mold is designed for creating a plastic receiver with a metal magazine slot with a cartridge ramp. The metal magazine slot with cartridge ramp is placed in the mold and covered with plastic using for example injection molding. Then the covered magazine slot with the cartridge ramp is further covered with raw plastic material as a whole that results into the plastic receiver using injection molding or another technique.

Figure 1:
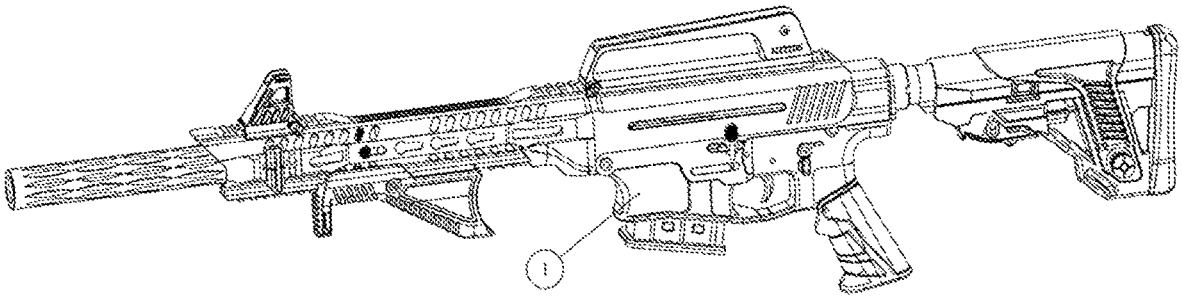
FIG. 1—General view of a firearm with a plastic receiver.
Figure 2A:
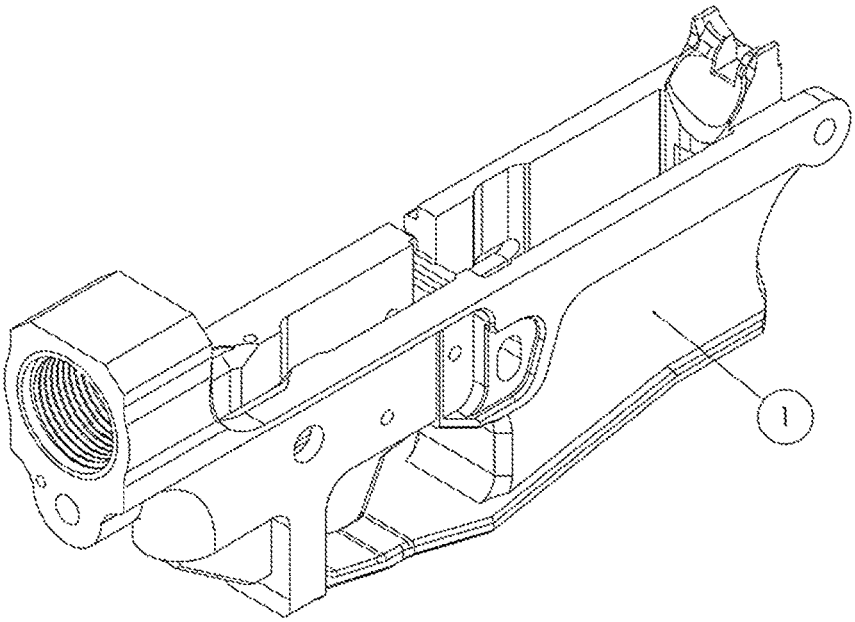
FIG. 2*a*—Front perspective view of the plastic receiver with a metal magazine slot with a cartridge ramp.

The view of the disclosure of the firearm as a whole is illustrated in FIG. 1. The subject matter of this disclosure is shown in FIGS. 2A and 2B where the metal magazine slot (2) with a cartridge ramp (2D) [FIG. 3C] is integrated unto a receiver body (1) that is formed from plastic by using injection molding or a casting method.

Figure 2B:
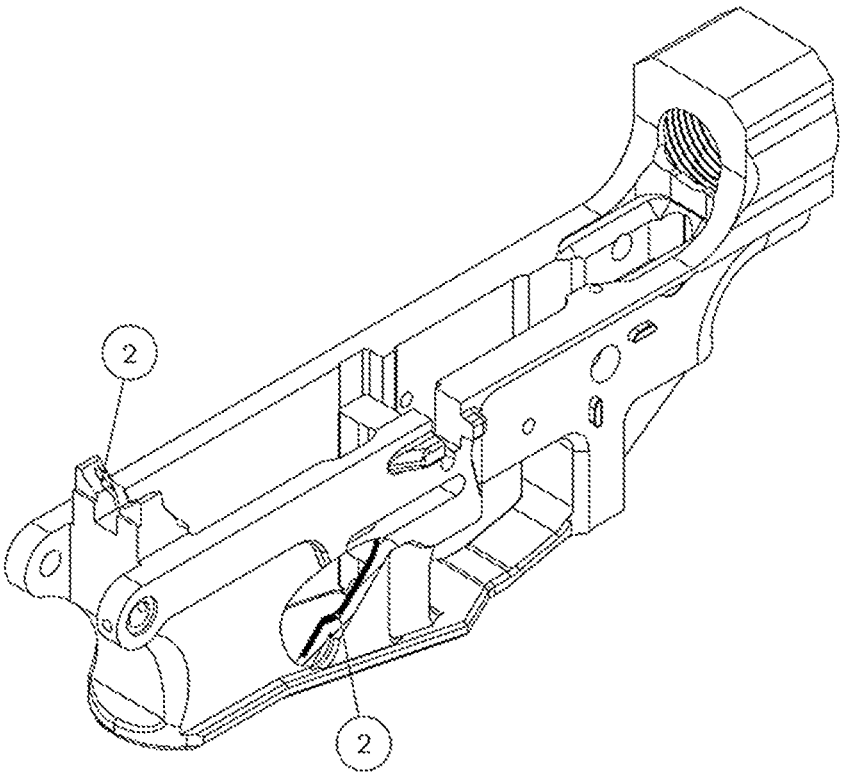
FIG. 2*b*—Rear perspective view of the plastic receiver with the metal magazine slot with the cartridge ramp.
Figure 3A:
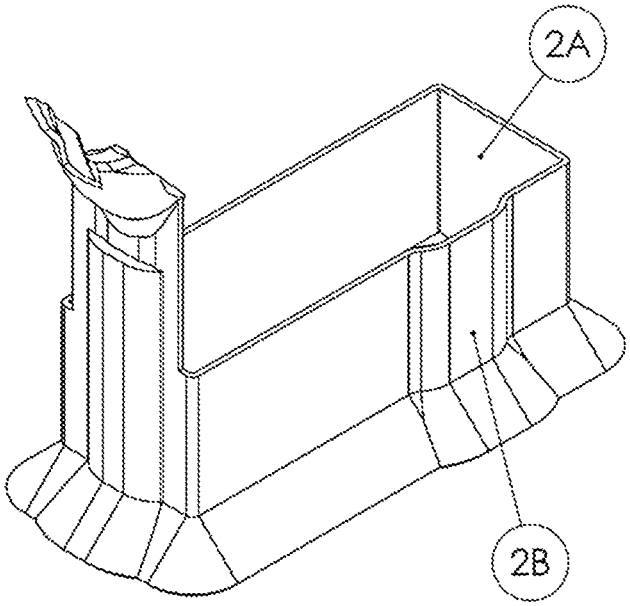
FIG. 3*a*—Front perspective view of the metal magazine slot with the cartridge ramp.
Figure 3B:
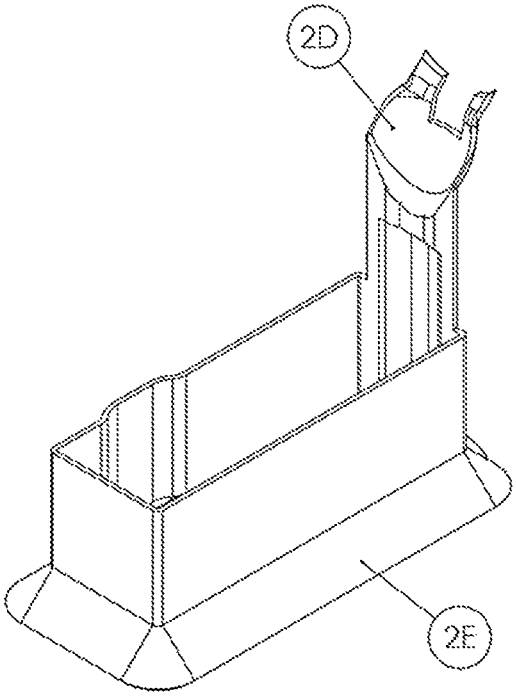
FIG. 3*b*—Rear perspective view of the metal magazine slot with the cartridge ramp.
Figure 3C:
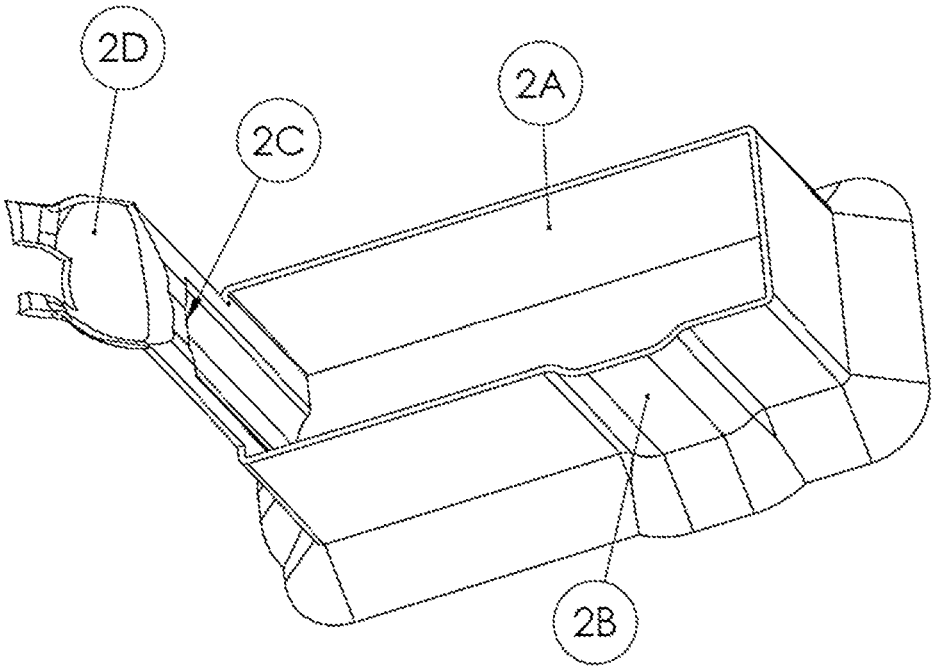
FIG. 3*c*—Top perspective view of the metal magazine slot with the cartridge ramp.

A magazine positioning opening (2A) in the middle of the metal magazine slot (2) FIG. 2B with the cartridge ramp (2D) as shown in FIG. 3C. The magazine positioning opening (2A) allows the rifle magazine to be attached to the receiver (1) of the rifle. The magazine locking groove (2B) is positioned on one side of the metal magazine slot (2) and in conjunction with the support protrusion (2C), positioned on the front side of the metal magazine slot (2) limits the movement of a magazine. The magazine locking groove (2B) allows the rifle magazine to remain fixed after it is placed on the receiver body (1). The magazine ramp (2D), which is an angled surface that allows the cartridges to be guided into to the barrel, is on the upper part of the metal magazine slot (2). At the bottom of the metal magazine slot (2), there is a preventive barrier (2E) that allows the magazine to be easily attached to the receiver body (1). The preventive barrier (2E) is in the form of an auricle that continues along the perimeter of the lower part of the metal magazine slot (2). With this structure, the preventive barrier (2E) prevents the magazine from damaging the opening of the receiver body (1) while the magazine is being inserted into the metal magazine slot (2).

The metal magazine slot (2) with the cartridge ramp (2D) is integrated inside the cavity of the receiver body (1) to form the final receiver body (1). After the injection or casting process is completed, a plastic receiver body (1) with a metal magazine slot (2) with the cartridge ramp (2D) is obtained, as shown in FIG. 2*a* and FIG. 2*b*.

What is claimed is:

1. A receiver body, comprising:

at least one metal magazine slot, having cuboid form and vertically embedded into a receiver body through injection molding or a casting of plastic material.

2. The receiver of claim 1, further comprising at least one metal cartridge ramp, having an angled surface positioned on an upper side of the at least one metal magazine slot.

3. The receiver of claim 1, further comprising at least one preventive barrier, having an auricle form, positioned along the opening of the metal magazine slot.

* * * * *